US009182186B1

(12) United States Patent
Prince

(10) Patent No.: US 9,182,186 B1
(45) Date of Patent: Nov. 10, 2015

(54) FIREARM MAGAZINE RELEASE LOCK

(71) Applicant: Darin Prince, Bonsall, CA (US)

(72) Inventor: Darin Prince, Bonsall, CA (US)

( * ) Notice: Subject to any disclaimer, the term of this patent is extended or adjusted under 35 U.S.C. 154(b) by 0 days.

(21) Appl. No.: 14/486,912

(22) Filed: Sep. 15, 2014

Related U.S. Application Data

(60) Provisional application No. 61/878,455, filed on Sep. 16, 2013.

(51) Int. Cl.
*F41A 17/38* (2006.01)

(52) U.S. Cl.
CPC ..... *F41A 17/38* (2013.01)

(58) Field of Classification Search
CPC ..... F41A 17/34; F41A 17/38
USPC ..... 42/6, 70.01, 70.02
See application file for complete search history.

(56) References Cited

U.S. PATENT DOCUMENTS 4,236,337 A * 12/1980 Beretta ..... 42/7
4,521,985 A * 6/1985 Smith et al. ..... 42/7
4,539,770 A * 9/1985 Bornancini ..... 42/7
4,899,476 A * 2/1990 Hindle ..... 42/7
6,173,519 B1 1/2001 Garrett
6,871,437 B1 * 3/2005 Bartozzi et al. ..... 42/70.11
D717,905 S * 11/2014 Prince ..... D22/108
2002/0178633 A1 * 12/2002 Rollins ..... 42/70.01
2006/0123683 A1 6/2006 Garrett et al.
2009/0031605 A1 2/2009 Robinson
2013/0227869 A1 * 9/2013 Thordsen ..... 42/6
2013/0269232 A1 * 10/2013 Harris et al. ..... 42/49.01
2014/0165439 A1 * 6/2014 Fernandez et al. ..... 42/6
2014/0317980 A1 * 10/2014 Michel ..... 42/6
2015/0052793 A1 * 2/2015 Cassady ..... 42/8

* cited by examiner

*Primary Examiner* — Bret Hayes
(74) *Attorney, Agent, or Firm* — QuickPatents; Kevin Prince

(57) ABSTRACT

A button lock for a depressible magazine release button bolt of a lower portion of a firearm of the type having a selectively removable upper portion includes a body having a top surface, a bottom surface, and at least one peripheral edge. The body includes a main aperture traversing the bottom surface and sized to accept a screw insert therein that itself includes a threaded bore for receiving the button bolt. The body includes at the top surface thereof a laterally-projecting extension terminating at a downwardly-projecting lip. The button bolt is engaged within screw insert in the main aperture. With the extension positioned over both the lower and upper portions of the firearm, the downwardly-projecting lip prevents the button bolt from being depressed when contacting the upper portion of the firearm. A permanent plug may be fixed within the main aperture to prevent removal of the screw insert after installation.

14 Claims, 3 Drawing Sheets

FIREARM MAGAZINE RELEASE LOCK

CROSS-REFERENCE TO RELATED APPLICATIONS

This application claims the benefit of U.S. Provisional Patent Application 61/878,455, filed on Sep. 16, 2013, and incorporated herein by reference.

STATEMENT REGARDING FEDERALLY SPONSORED RESEARCH AND DEVELOPMENT

Not Applicable.

FIELD OF THE INVENTION

This invention relates to firearms, and more particularly to a button lock for AR-15 type firearms.

DISCUSSION OF RELATED ART

In some jurisdictions with excessive firearm regulations it is illegal to have a "quick release" button on certain firearms to release an ammunition magazine without a tool, even if quick rearming is necessary to properly defend oneself or one's property. To aid those who may be caught in a situation requiring quick rearming but who do not have handy access to a proper tool to release and exchange a magazine, several prior art devices have been developed to still allow for relatively quick releasing of a magazine with the use of a commonly accessible tool, including my magazine release mechanism known in the market as "Bullet Button" (www.BulletButton.com). Another related device is taught in U.S. Pat. No. 6,173,519 to Garrett on Jan. 16, 2001 that includes its own easily-stowed tool.

In certain overzealous jurisdictions, new regulations further require that the firearm not have a releasable magazine unless the firearm is in some state of disassembly. As such, existing firearms that provide for releasing their magazine when fully assembled are no longer legal in such jurisdictions, and owners of such firearms have no easy way to modify their firearms to regain compliance with the law.

Therefore, there is a need for a device that disables such a magazine release button without requiring extensive modification of the firearm when the firearm is assembled. Such a needed device would allow the magazine release button of the firearm to be depressed when an upper portion of the firearm is disassembled from a lower portion of the firearm. Such a needed device would be relatively inexpensive to manufacture and ship, and relatively easy to install. The present invention accomplishes these objectives.

SUMMARY OF THE INVENTION

The present device is a button lock for a depressible magazine release button bolt of a lower portion of a firearm. The firearm is of the type having a selectively removable upper portion. The firearm may be an AR-15 type rifle, for example, having a magazine release button typically fixed with the button bolt which, when depressed, releases a magazine of the firearm. In some jurisdictions, such a rapid release button is not permitted if the firearm is completely assembled, and therefore the magazine release must be disabled when the firearm is assembled, such as when the upper portion and the lower portion are mutually joined.

The button lock includes a rigid, preferably metallic body having a top surface, a bottom surface, and at least one peripheral edge. The body includes a main aperture traversing the top surface and sized to slidably accept a screw insert therein. The body further includes a smaller button bolt aperture adapted for slidably receiving the button bolt therethrough. A retaining lip is defined between the main aperture and the bottom surface of the body.

The screw insert has a threaded bore through a lower end thereof adapted for receiving the threaded button bolt therein. The screw insert includes at a top end at least one tool notch, which allows the screw insert to be rotated onto the threaded button bolt from the top end (and through the main aperture through the top surface of the body) with a tool, such as a screw driver. The outside diameter of the screw insert is larger than the button bolt aperture and is therefore prevented from exiting the body at the bottom surface thereof. However, the screw insert may be inserted into the main aperture through the top surface of the body.

The body further includes at the top surface thereof a laterally-projecting extension terminating at a downwardly-projecting lip. The downwardly-projecting lip of the extension may further include a threaded aperture adapted to receive a threaded adjustment screw therein. Preferably the laterally-projecting extension and the body are integrally formed.

In use, the button bolt is engaged through the button bolt aperture of the body and then with the threaded bore of the screw insert. The screw insert is then adjusted on the button bolt. The threaded adjustment screw is then adjusted in the threaded aperture of the downwardly-projecting lip of the laterally-projecting extension, such that in the normal position of the button bolt the adjustment screw is just slightly away from the upper portion of the firearm. As such, with the laterally projecting extension positioned over both the lower and upper portions, of the firearm, the downwardly-projecting lip and adjustment screw prevent the button bolt from being depressed when the adjustment screw contacts the upper portion of the firearm. But when the upper portion of the firearm is removed from the lower portion, the downwardly-projecting lip and adjustment screw clear the lower portion to allow pressing of the button bolt and subsequent removal of the magazine.

An aperture plug may be included for permanently fitting into the main aperture at the top surface for preventing detachment of the screw insert with the button bolt. Such an aperture plug may be a rigid metallic plug that has a press-fit into the main aperture. Alternately, a welded plug may be used once the button lock is installed on the firearm. Alternately, a strong adhesive material (not shown) may be applied to the top end of the screw insert.

The present invention is a device that disables a magazine release button of a firearm, without requiring extensive modification of the firearm, when the firearm is assembled. The present device allows the magazine release button of the firearm to be depressed when an upper portion of the firearm is disassembled from a lower portion of the firearm. The present invention is inexpensive to manufacture and ship, and relatively easy to install. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
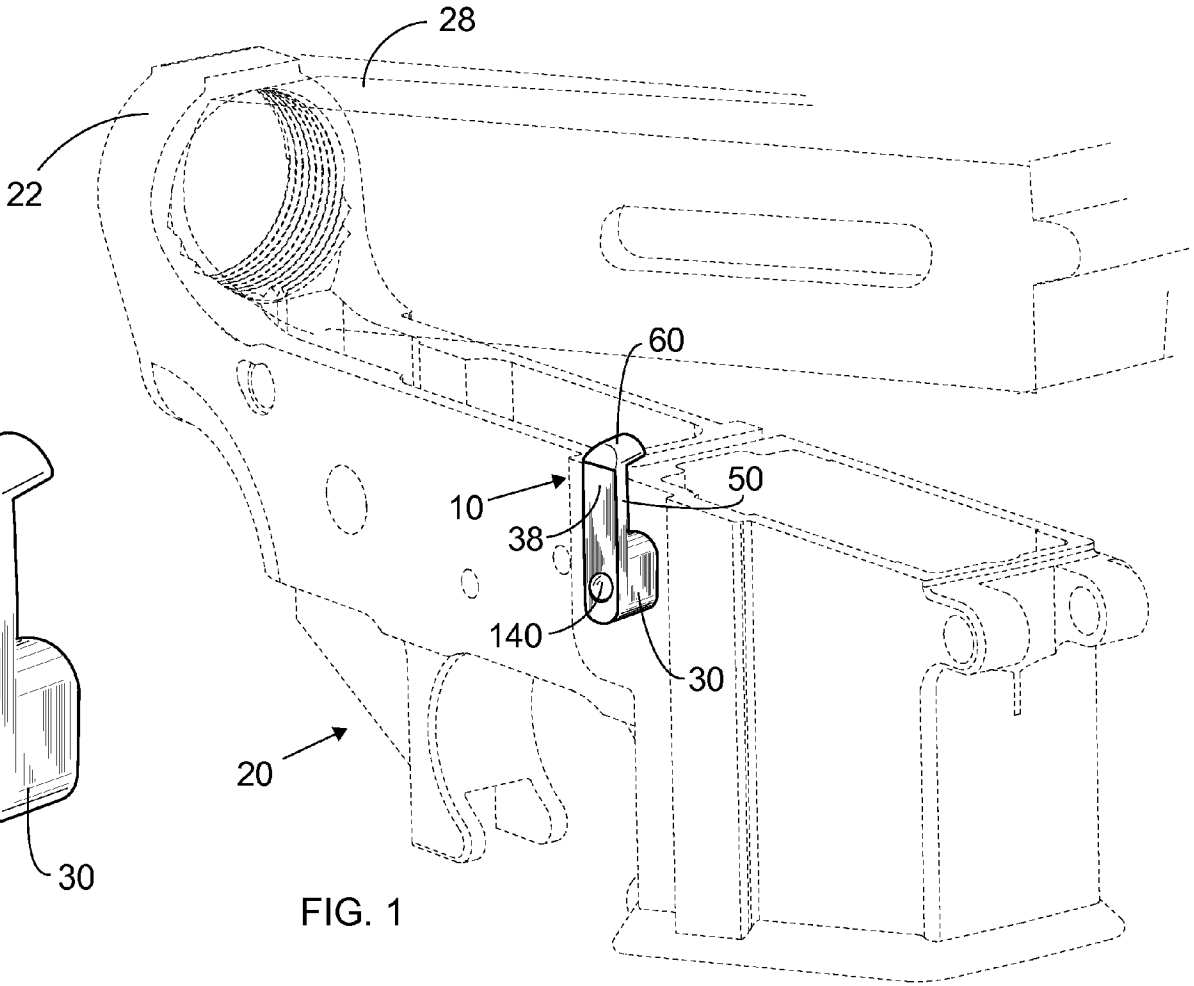
FIG. 1 is a perspective view of the invention as installed on a firearm.
Figure 2:
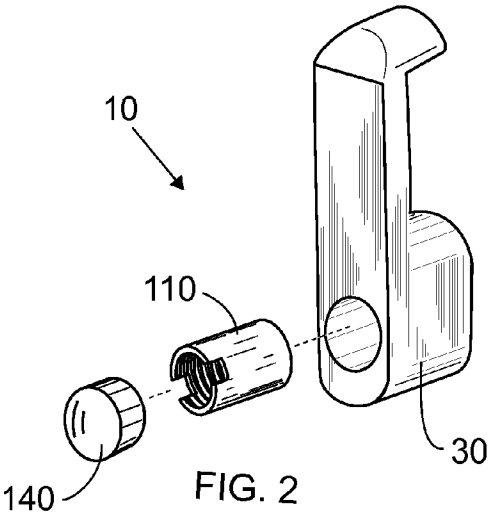
FIG. 2 is an enlarged perspective view of the invention.

FIGS. 1 and 2 illustrate a button lock 10 for a depressible magazine release button bolt 25 of a lower portion 22 of a firearm 20. The firearm 20 is of the type having a selectively removable upper portion 28. The firearm 20 may be an AR-15 type rifle, for example, having a magazine release button (not shown) typically fixed with the button bolt 25 (FIGS. 6 and 7) which, when depressed, releases a magazine (not shown) of the firearm 20. In some jurisdictions, such a rapid release button is not permitted if the firearm 20 is completely assembled, and therefore the magazine release must be disabled when the firearm 20 is assembled, such as when the upper portion 28 and the lower portion 22 are mutually joined.

Figure 3:
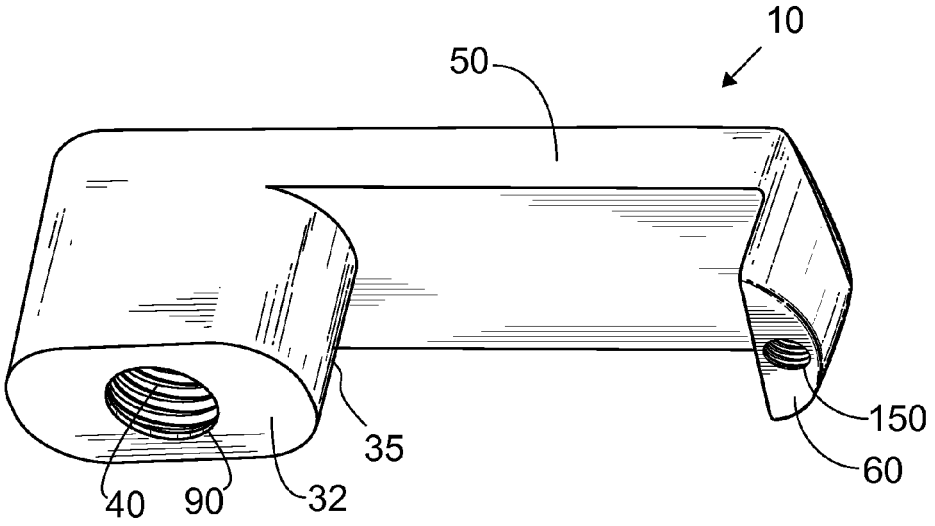
FIG. 3 is a rear perspective view of the invention.
Figure 4:
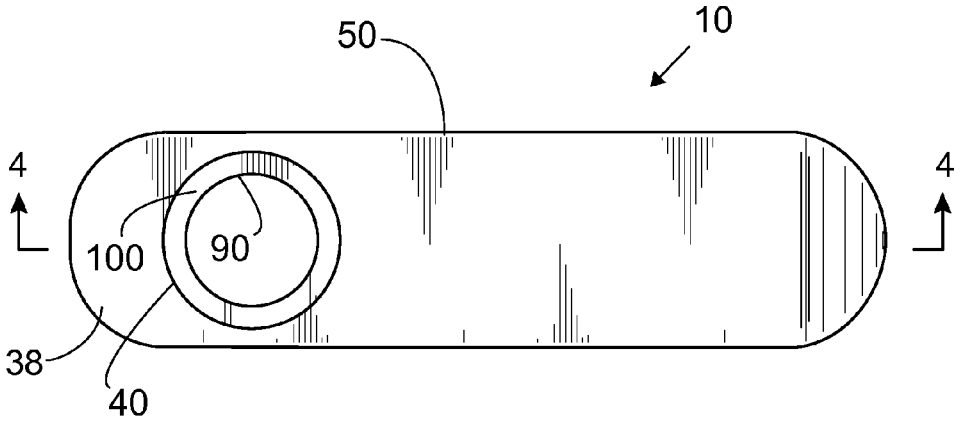
FIG. 4 is a top plan view of FIG. 2 but with a screw insert and a plug omitted for clarity of illustration.
Figure 5:
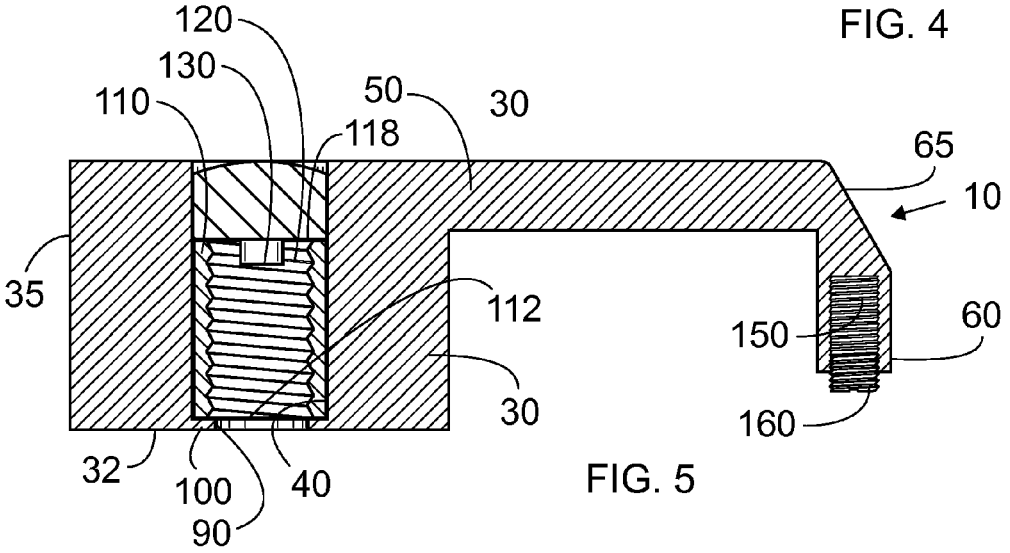
FIG. 5 is a cross-sectional view of FIG. 4, taken generally along line 5-5.
Figure 6:
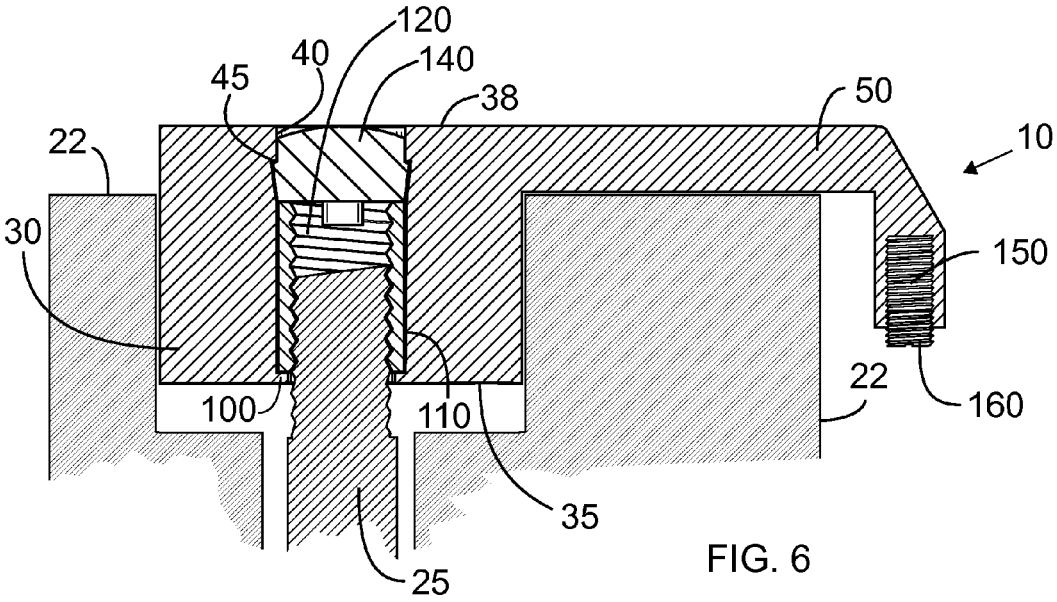
FIG. 6 is a cross-sectional view of FIG. 4, taken generally along line 5-5, as installed in the firearm and including the screw insert and plug.

The button lock 10 includes a rigid, preferably metallic body 30 having a top surface 38, a bottom surface 32, and at least one peripheral edge 35. The body 30 includes a main aperture 40 traversing the top surface 38 and sized to slidably accept a screw insert 110 therein (FIGS. 5 and 6). The body 30 further includes a smaller button bolt aperture 90 adapted for slidably receiving the button bolt 25 therethrough. A retaining lip 100 (FIGS. 3-5) is defined between the main aperture 40 and the bottom surface 38 of the body 30.

The screw insert 110 has a threaded bore 120 through a lower end 112 thereof (FIG. 5) adapted for receiving the threaded button bolt 25 therein. The screw insert 110 includes at a top end 118 at least one tool interface or notch 130, which allows the screw insert 110 to be rotated onto the threaded button bolt 25 from the top end 118 (and through the main aperture 40 through the top surface 38 of the body) with a tool, such as a screw driver (not shown). The outside diameter of the screw insert 110 is larger than the button bolt aperture 90 and is therefore prevented from exiting the body 30 at the bottom surface 32 thereof. However, the screw insert 110 may be inserted into the main aperture 40 through the top surface 38 of the body.

The body 30 further includes at the top surface 38 thereof a laterally-projecting extension 50 terminating at a downwardly-projecting lip 60. The laterally projecting extension 50 and downwardly-projecting lip 60 are integrally formed with a beveled edge 65 therebetween. The downwardly-projecting lip 60 of the extension 50 may further include a threaded aperture 150 adapted to receive a threaded adjustment screw 160 therein (FIGS. 3 and 5-7). Preferably the laterally-projecting extension 50 and the body 30 are integrally formed, as illustrated in FIGS. 1-3, 5 and 6.

Figure 7:
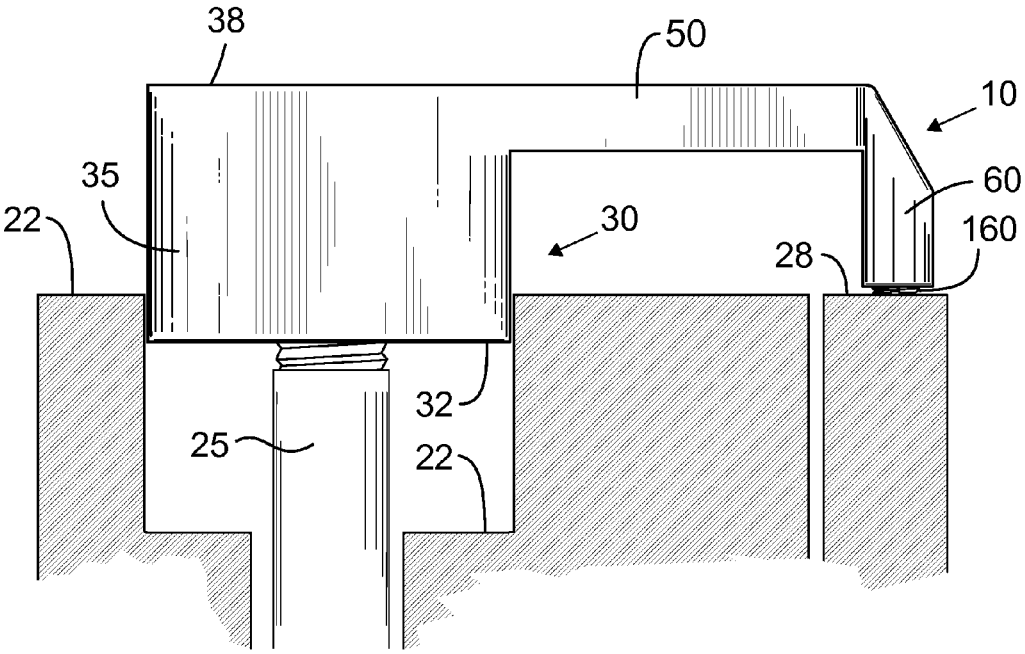
FIG. 7 is a side elevational view of FIG. 6, as installed in the firearm.

In use, the button bolt 25 is engaged through the button bolt aperture 90 of the body 30 and then with the threaded bore 120 of the screw insert 110. The screw insert 110 is then adjusted on the button bolt 25. The threaded adjustment screw 160 is then adjusted in the threaded aperture 150 of the downwardly-projecting lip 60 of the laterally-projecting extension 50, such that in the normal position of the button bolt 25 the adjustment screw 160 is just slightly away from the upper portion 28 of the firearm 20. As such, with the laterally projecting extension 50 positioned over both the lower and upper portions 22,28 of the firearm 20, the downwardly-projecting lip 60 and adjustment screw 160 prevent the button bolt 25 from being depressed when the adjustment screw 160 contacts the upper portion 28 of the firearm (FIG. 7). But when the upper portion 28 of the firearm is removed from the lower portion 22 (FIG. 6), the downwardly-projecting lip 60 and adjustment screw 160 clear the lower portion 22 to allow pressing of the button bolt 25 and subsequent removal of the magazine (not shown).

An aperture plug 140 may be included for permanently fitting into the main aperture 40 at the top surface 38 for preventing detachment of the screw insert 110 with the button bolt 25. Such an aperture plug 140 may be a rigid metallic plug that has a press-fit into the main aperture 40. Alternately, a welded plug (not shown) may be used once the button lock 10 is installed on the firearm 20. Alternately, a strong adhesive material (not shown) may be applied to the top end of the screw insert 110. Alternately, a one-way snap arrangement 45 (FIG. 6) may be formed in the main aperture 40 and aperture plug 140.

While a particular form of the invention has been illustrated and described, it will be apparent that various modifications can be made without departing from the spirit and scope of the invention. For example, the shape of the body 30 in the bottom plan view is rectangular with rounded corners, but other shapes may be utilized according to the specific firearm 20 to which the button lock 10 is to be attached. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A button lock for a threaded, depressible magazine release button bolt of a lower portion of a firearm, the firearm also having a selectively removable upper portion, the button lock comprising:

a body having a top surface, a bottom surface, and at least one peripheral edge, the body including a main aperture traversing the top surface and a smaller button bolt aperture adapted for slidably receiving the button bolt, a retaining lip defined between the main aperture and the bottom surface, the body including at the top surface thereof a laterally-projecting extension terminating at a downwardly-projecting lip;

a screw insert slidably retained within the main aperture and having a threaded bore adapted for receiving the button bolt through a lower end thereof, the screw insert further including at a top end at least one tool notch, the screw insert larger than the button bolt aperture and prevented from exiting the body therethrough;

whereby with the button bolt engaged with the screw insert through the button bolt aperture of the body through rotating the screw insert at the at least one tool notch to engaged the threads of the screw insert with the threads of the button bolt, and with the laterally projecting extension positioned over both the lower and upper portions of the firearm, the downwardly-projecting lip prevents the button bolt from being depressed when contacting the upper portion of the firearm, but when the upper portion of the firearm is removed from the lower portion the downwardly-projecting lip clears the lower portion to allow depressing of the button bolt.

2. The button lock of claim 1 further including an aperture plug that may be permanently fitted into the main aperture at the top surface for preventing detachment of the screw insert with the button bolt.

3. The button lock of claim 1 wherein the aperture plug is permanently fitted into the main aperture with a permanent adhesive.

4. The button lock of claim 3 wherein the aperture plug is permanently fitted into the main aperture with a mechanical one-way snap.

5. The button lock of claim 1 wherein the downwardly-projecting lip of the extension includes a threaded aperture adapted to receive a threaded adjustment screw therein.

6. The button lock of claim 1 wherein the laterally projecting extension and the body are integrally formed.

7. The button lock of claim 1 wherein the laterally projecting extension and downwardly-projecting lip are integrally formed with a beveled edge therebetween.

8. The button lock of claim 6 further including an aperture plug that may be permanently fitted into the main aperture at the top surface for preventing detachment of the screw insert with the button bolt.

9. The button lock of claim 8 wherein the aperture plug is permanently fitted into the main aperture with a permanent adhesive.

10. The button lock of claim 8 wherein the aperture plug is permanently fitted into the main aperture with a mechanical one-way snap.

11. A button lock for a threaded, depressible magazine release button bolt of a lower portion of a firearm, the firearm also having a selectively removable upper portion, the button lock comprising:

a body having a top surface, a bottom surface, and at least one peripheral edge, the body including a main aperture traversing the top surface and a smaller button bolt aperture adapted for receiving the button bolt therethrough, a retaining lip defined between the main aperture and the bottom surface, the body including at the top surface thereof a laterally-projecting extension terminating at a downwardly-projecting lip;

a screw insert slidably retained within the main aperture and having a threaded bore adapted for receiving the button bolt through a lower end thereof, the screw insert further including at a top end at least one tool interface, the screw insert larger than the button bolt aperture and thereby prevented from exiting the body therethrough;

whereby with the button bolt engaged with the screw insert through the button bolt aperture of the body through rotating the screw insert at the at least one tool interface to engaged the threads of the screw insert with the threads of the button bolt, and with the laterally projecting extension positioned over both the lower and upper portions of the firearm, the downwardly-projecting lip prevents the button bolt from being depressed when contacting the upper portion of the firearm, but when the upper portion of the firearm is removed from the lower portion the downwardly-projecting lip clears the lower portion to allow depressing of the button bolt.

12. The button lock of claim 11 wherein the downwardly-projecting lip of the extension includes a threaded aperture adapted to receive a threaded adjustment screw therein.

13. The button lock of claim 11 wherein the laterally projecting extension and the body are integrally formed.

14. The button lock of claim 11 wherein the laterally projecting extension and downwardly-projecting lip are integrally formed with a beveled edge therebetween.

* * * * *